US008915332B2

(12) United States Patent
Jezek

(10) Patent No.: US 8,915,332 B2
(45) Date of Patent: Dec. 23, 2014

(54) DEVICE FOR SAVING ENERGY DURING VERTICAL AND HORIZONTAL MOTIONS

(76) Inventor: Giorgio Jezek, Cognola Di Trento (IT)

( * ) Notice: Subject to any disclaimer, the term of this patent is extended or adjusted under 35 U.S.C. 154(b) by 248 days.

(21) Appl. No.: 13/498,112

(22) PCT Filed: Sep. 14, 2011

(86) PCT No.: PCT/IB2011/053760

§ 371 (c)(1),
(2), (4) Date: Mar. 23, 2012

(87) PCT Pub. No.: WO2012/143765

PCT Pub. Date: Oct. 26, 2012

(65) Prior Publication Data

US 2014/0097045 A1 Apr. 10, 2014

(30) Foreign Application Priority Data

Apr. 27, 2011 (WO) ..... PCT/IB2011/051715

(51) Int. Cl.

| | |
|---|---|
| ***B66B 11/04*** | (2006.01) |
| ***B66D 1/02*** | (2006.01) |
| ***B66D 1/22*** | (2006.01) |
| ***F16H 1/20*** | (2006.01) |
| ***F16H 37/06*** | (2006.01) |
| *B66B 11/08* | (2006.01) |
| *B66D 1/26* | (2006.01) |

(52) U.S. Cl.

CPC ..... *B66B 11/0453* (2013.01); *B66B 11/043* (2013.01); *B66B 11/0476* (2013.01)

USPC ..... 187/250; 74/420; 74/421 A; 74/665 GC; 254/266; 254/278; 254/294; 254/316; 198/791; 475/230; 475/343; 187/254; 187/256

(58) Field of Classification Search

CPC ..... B66D 1/02; B66D 1/26; B66B 11/08; B66B 11/06; B66B 11/043; B66B 11/0476; B66B 11/0453

USPC ..... 74/665 GC, 665 GE, 420, 421 A, 423; 187/254, 250, 256; 182/69.6, 141, 151, 182/158; 254/202, 213, 219, 266, 290, 293, 254/294, 295, 297, 316; 198/315, 330, 198/343.2, 463.2, 510.1, 527, 542, 667, 198/674, 791; 475/220, 221, 230, 331, 343

See application file for complete search history.

(56) References Cited

U.S. PATENT DOCUMENTS 129,339 A * 7/1872 Hawkes ..... 74/424.5
612,780 A * 10/1898 Mansione ..... 187/250

(Continued)

FOREIGN PATENT DOCUMENTS

EP 2 013 960 1/2009
WO 2007/129150 A1 11/2007

(Continued)

*Primary Examiner* — William A Rivera
*Assistant Examiner* — Stefan Kruer
(74) *Attorney, Agent, or Firm* — Pearne & Gordon LLP

(57) ABSTRACT

A mechanical device for reducing the energy absorbed by an electric motor of a handling plant. The device includes a first rotating member moved by the motor of the handling plant. The device also includes a second rotating member connected to the first member through a first transmission apparatus. A third rotating member is connected to the second rotating member through a second transmission apparatus, which develops a transmission ratio equal to unity. The device further includes a fourth rotating member operatively connected to the rotor of the electric motor. The fourth rotating member and the third rotating member are connected through a third transmission apparatus, which develops a transmission ratio equal to unity. The device includes a sixth rotating member connected to a fifth rotating member through a fifth transmission apparatus. The sixth rotating member and the first rotating member are connected through a sixth transmission apparatus.

16 Claims, 6 Drawing Sheets

(56) References Cited

U.S. PATENT DOCUMENTS

| | | | | | |
|---|---|---|---|---|---|
| 1,181,322 | A | * | 5/1916 | Lambert | 254/310 |
| 1,610,462 | A | * | 12/1926 | Matthewson et al. | 254/290 |
| 1,649,908 | A | * | 11/1927 | McIntyre | 254/348 |
| 1,735,767 | A | * | 11/1929 | Keller et al. | 198/791 |
| 2,271,430 | A | * | 1/1942 | Harry | 254/279 |
| 2,748,919 | A | * | 6/1956 | Britton et al. | 198/791 |
| 3,378,232 | A | * | 4/1968 | McIntyre et al. | 254/303 |
| 3,387,823 | A | * | 6/1968 | Van De-Hey et al. | 254/295 |
| RE26,505 | E | * | 12/1968 | Thompson, Jr. | 254/305 |
| 3,614,066 | A | * | 10/1971 | Day | 254/299 |
| 3,785,504 | A | * | 1/1974 | Cheldelin et al. | 212/84 |
| 3,788,606 | A | * | 1/1974 | Solter | 254/290 |
| 4,015,706 | A | * | 4/1977 | Goffredo et al. | 198/583 |
| 4,047,451 | A | * | 9/1977 | Ackerman | 74/665 H |
| 4,058,295 | A | * | 11/1977 | Morfitt | 254/291 |
| 4,353,527 | A | * | 10/1982 | Langford | 254/304 |
| 4,663,128 | A | * | 5/1987 | Helgeland | 117/201 |
| 4,700,589 | A | * | 10/1987 | Coronel | 475/6 |
| 5,259,823 | A | * | 11/1993 | Coronel | 475/257 |
| 5,319,418 | A | * | 6/1994 | Fujimoto et al. | 399/167 |
| 5,662,009 | A | * | 9/1997 | Palmer | 74/810.1 |
| 5,910,060 | A | * | 6/1999 | Blume | 475/28 |
| 7,270,312 | B1 | * | 9/2007 | Phipps et al. | 254/297 |
| 8,578,818 | B2 | * | 11/2013 | Jezek | 74/665 GC |

FOREIGN PATENT DOCUMENTS

| | | | | | |
|---|---|---|---|---|---|
| WO | 2010/134106 | A2 | | 2/2010 | |
| WO | WO 2012114163 | A1 | * | 8/2012 | B66B 11/04 |
| WO | WO 2012143765 | A1 | * | 10/2012 | B66B 11/04 |

* cited by examiner

DEVICE FOR SAVING ENERGY DURING VERTICAL AND HORIZONTAL MOTIONS

FIELD OF THE INVENTION

The present invention falls within the field of production of handling plants, such as, for example, lifts or cup elevators. In particular, the present invention regards a mechanical device for reducing the energy absorbed by the electric motor of a handling plant. The present invention also relates to a handling plant comprising a mechanical device according to the present invention.

DESCRIPTION OF THE RELATED ART

As is known, the majority of handling plants or material and/or person handling systems, for example lifts, cup elevators, or the like, comprise a driving unit provided for enabling movement of one or more transport units. In the majority of cases, the driving unit comprises an electric motor, whereas the transport units are designed to transport objects or persons according to the operating situation. In the case, for example, of a handling plants of a lift type, the driving unit is constituted by an electric motor (synchronous, asynchronous, or gearless), whereas the transport unit is constituted by a cab for transporting persons. The electric motor generally drives a rotation pulley, over which handling cables are run. Connected to a first end of the cables is a cab, whereas connected to a second end is a counterweight.

It is likewise known that the movement of the cab from a first position to a second position imposes an operation of the motor that can be divided into three phases: a first, acceleration, phase; a second phase at substantially constant speed; and a third, deceleration, phase. In the acceleration phase, the motor is required to deliver the maximum power to overcome the inertia of the system. In the deceleration phase, the motor functions as generator for braking rotation of the motor until it comes to a complete stop.

In the step at constant speed, the electric motor delivers onto its motor shaft a torque that can be considered defined as the sum of two contributions. The first of these contributions is the one necessary to overcome the difference of weight existing between the cab (Ca+Q) and the counterweight, whereas the second is the one necessary to overcome the passive resistance, where the term "passive resistance" refers in general to friction and efficiency.

The frequent use of handling plants, in particular in the case of lifts, has highlighted the need to develop new technical solutions that will enable reduction as much as possible of the energy absorbed by the electric motor and hence of the overall energy required by operation of the system. Said need arises not only in regard to newly designed and built systems, but also with reference to existing systems that have been in operation for years.

Consequently, the task of the present invention is to provide a device for reduction of the energy absorbed by the electric motor of a handling plant during operation thereof.

Within this task, a purpose of the present invention is to provide a device that can be adapted to different handling plants, amongst which, for example, lifts or cup elevators.

Another purpose of the present invention is to provide a device that is easy to assemble and is made up of a relatively reduced number of components.

Not the least important purpose is to provide a device that is reliable and easy to produce at competitive costs.

SUMMARY OF THE INVENTION

The present invention regards a mechanical device for reducing the energy absorbed by an electric motor of a handling plant. The mechanical device according to the invention comprises at least one first rotating member, which is to be driven in rotation by the electric motor of the handling plant to which the device is applied. The device also comprises a second rotating member connected to the first member through first transmission means that develop a transmission ratio substantially equal to unity. At least one third rotating member is connected to the second rotating member through second transmission means that develop a transmission ratio equal to unity. The device further comprises a fourth rotating member, operatively connected to the rotor of the electric motor. The fourth rotating member and the third rotating member are connected through third transmission means, which develop a transmission ratio substantially equal to unity. In particular, according to the invention the fourth rotating member rotates in a way concordant with the first rotating member.

The present invention also regards a handling plant comprising an electric motor that actuates at least one transport unit through a system of cables and/or belts. The handling plant according to the invention comprises a mechanical device according to the invention for reducing the energy absorbed by the electric motor of the system itself.

BRIEF DESCRIPTION OF THE DRAWINGS

Further characteristics and advantages of the present invention will emerge clearly from the description of two embodiments, illustrated by way of non-limiting example in the attached drawings, in which.

It is to be noted that the embodiments showed in FIGS. 1-4 are not part of the claimed invention.

DETAILED DESCRIPTION OF THE INVENTION

The device 1 according to the invention can be installed in any handling or transporting plant in general provided with a motor and at least one transport unit driven by the motor itself through a system of cables and/or belts. In particular, it has been seen that the device 1 according to the invention is particularly advantageous when it is installed in handling plants 2 equipped with an electric motor of the type indicated in the patent application No. EP2013960 filed in the name of the present applicant. In particular, said motor M comprises an external body connected to the rotor part of the motor itself. On said external body grooves 4B are defined, which are to house handling cables Fs and, as specified hereinafter, further flexible elements (belts and/or cables) corresponding to motion-transmission means of the device 1 according to the invention.

Figure 2:
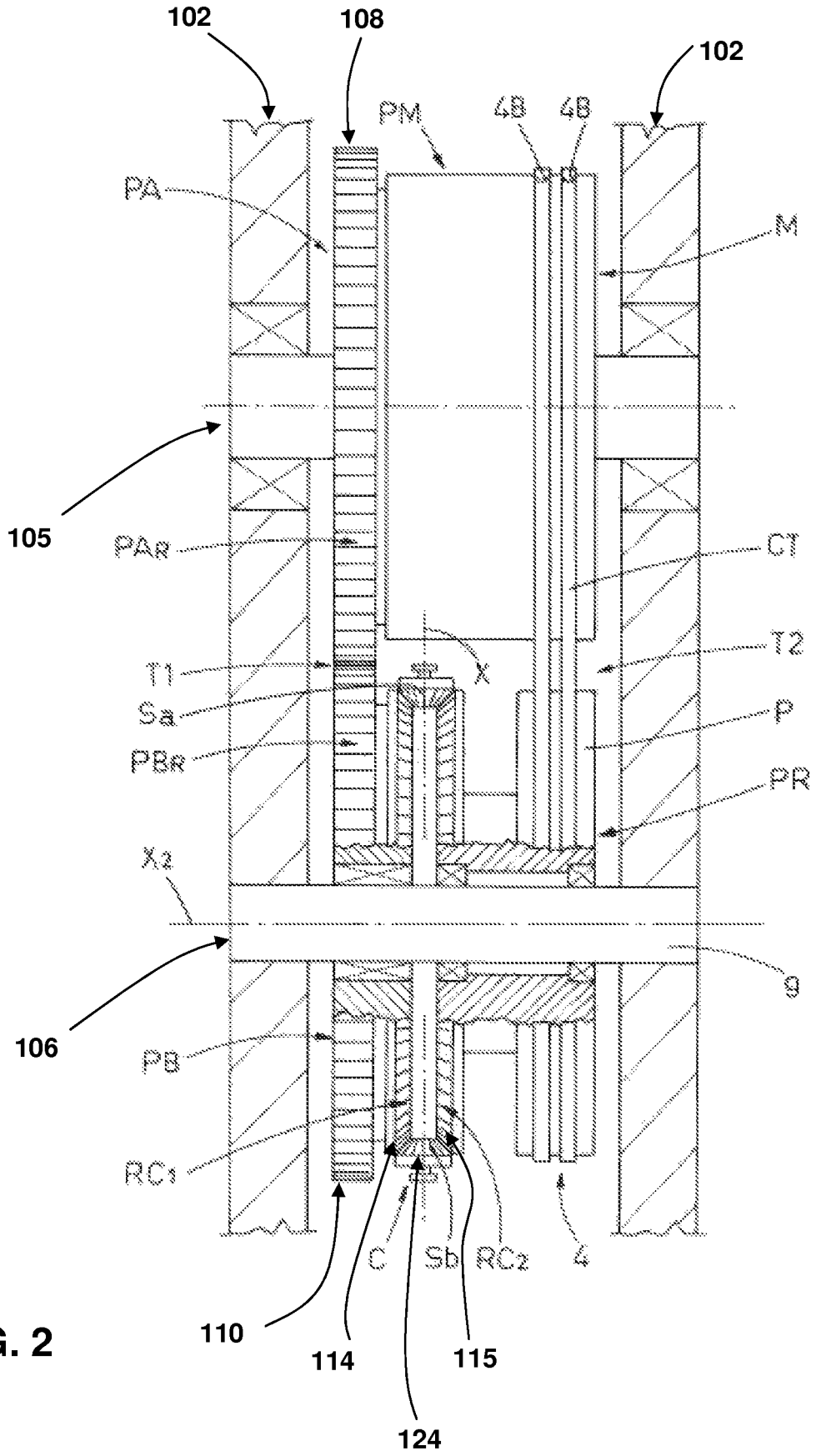
FIG. 2 is a top plan view of a possible embodiment of a device according to the present invention.

The device 1 comprises at least one first rotating member PA which is to be driven, i.e., brought into rotation, by the electric motor M of a handling plant 2 to which the device is applied. In detail, the first rotating member PA is moved by the motor M through a connection, which develops a transmission ratio substantially equal to unity. Said connection is such as to render the first member PA fixed with respect to the motor M, as illustrated in FIGS. 2 and 3.

The device 1 also comprises a second rotating member PB, connected to the first member PA through first transmission means T1 that develop a transmission ratio substantially equal to unity. The mechanical device 1 also comprises a third rotating member PR, connected to the second rotating member PB through second transmission means C that develop a transmission ratio equal to unity. The device 1 further comprises a fourth rotating member PM, operatively connected to the rotor of the motor M and connected to the third rotating member PR through third transmission means T2 that develop a transmission ratio substantially equal to unity.

Figure 3:
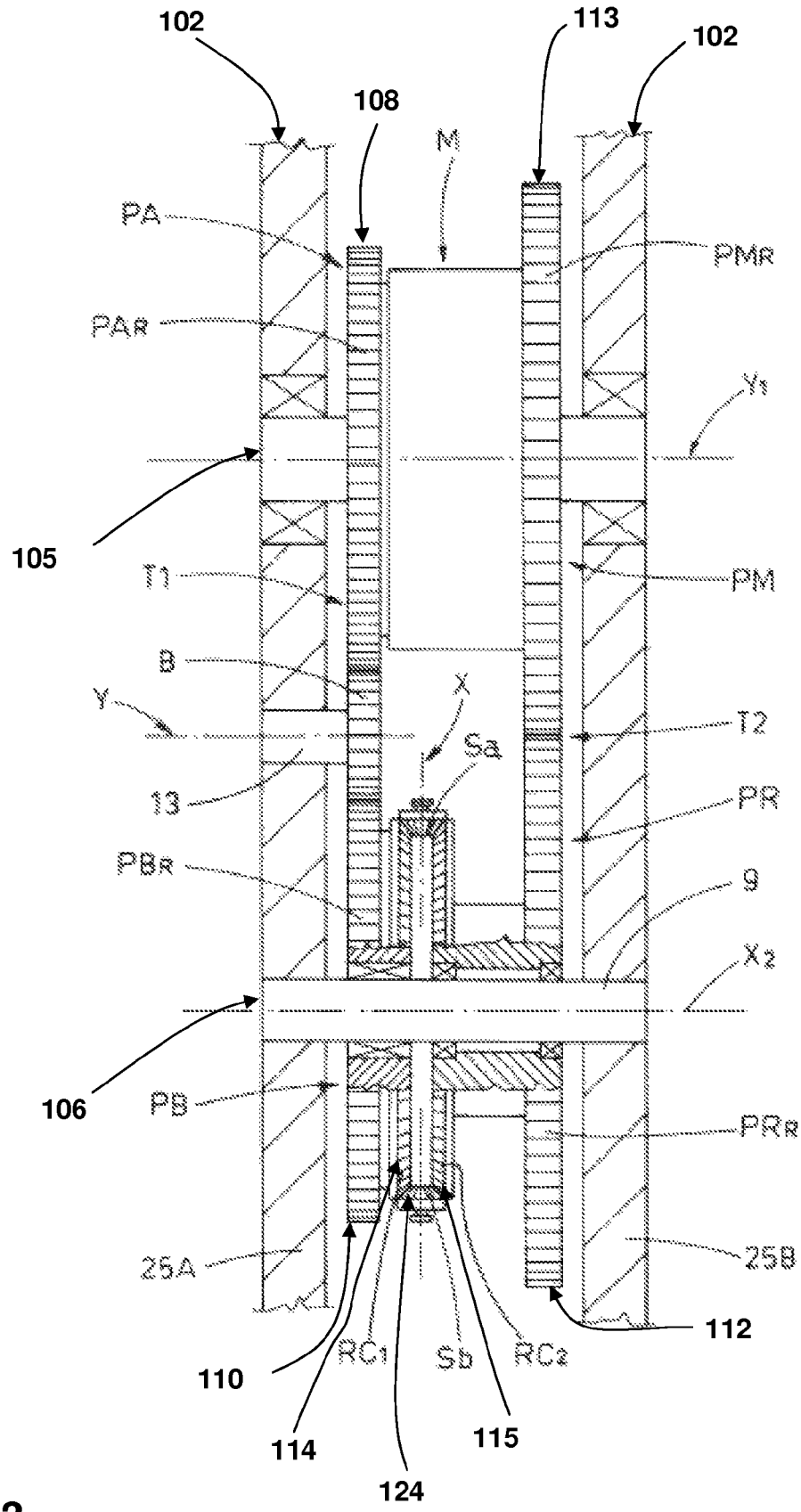
FIG. 3 is a top plan view regarding a further possible embodiment of a device according to the present invention.

The fourth rotating member PM can be formed by an external part of the motor M connected to the rotor thereof (see FIGS. 2 and 3) or alternatively can be formed by an element fitted coaxially on the rotor itself (see FIG. 3). As described in detail hereinafter, the third transmission means T2 can comprise a transmission with flexible elements (for example, ropes) that operatively connect the third rotating member PR to the outer body of the motor M (fourth rotating member PM) as illustrated in the embodiments in FIGS. 2 and 3. Alternatively, the third transmission means T2 can comprise a gear transmission formed by two or more gears that operatively connect the third rotating member PR to the fourth rotating member PM.

According to the present invention the first transmission means T1, the second transmission means C, and the third transmission means T2 are configured in such a way that the fourth rotating member PM will turn in a direction of rotation concordant with the rotor of the motor shaft M. In other words, the transmission means T1, C, T2 are configured in such a way that the fourth rotating member PM tends to rotate in a counterclockwise direction when the rotor of the motor M also rotates in a counterclockwise direction, and vice versa.

It has been seen that through the device 1 it is possible to obtain, as compared to traditional solutions that do not envisage it, a reduction of the torque required of the motor M (i.e., a reduction of the power used) during operation of the handling plant. In the case, for example, of a plant 2 of the lift type it may be seen that the device 1 enables balancing of the torque necessary to overcome the difference in weight between the cab and the counterweight in conditions of brake open or else of electric motor M turned off. This condition of equilibrium is advantageously maintained also during rise or descent of the lift. It follows that in this operating phase, the motor M will have to generate a torque (and hence absorb a power) that must be sufficient to overcome only the passive resistance (friction, efficiency of the transmission means, T1, C and T2). This means that during operation of the lift, the motor M is no longer required to deliver any power for balancing the difference of weight between the cab and the counterweight. The device 1 in fact maintains said equilibrium over time. In brief, during operation of the lift, the difference in weight between the cab and the counterweight generates two equivalent torques, on the fourth rotating member PM, which counter one another so that on the motor M the necessary torque will be practically zero. Said principle may be applied in multiple types of movement in addition to the field of lifts.

In the field of handling movement we should have the following:

$$Q \leq ca;\ Cp = Ca + \tfrac{1}{2}Q;\ O \leq Z \leq \tfrac{1}{2}Q$$

where Z is the difference in weight between the cab loaded and the counterweight.

To obtain a good energy saving in the acceleration and deceleration phases of the possible elevator cab and counterweight (in the case of the present example), the static torque or the deceleration torque should never exceed Z×r (where r is the radius of the motor that carries out hoisting). In order to arrive at this it will be expedient to consider the effective capacity of the cab, which is lower by a certain percentage than the capacity: Q≤ca. We thus obtain that the torque that is generated in acceleration and deceleration will not exceed the value of Z×r, which is the limit torque that is split into two torques "Z/2" and "−Z/2", which cancel out. It is emphasized that, in the traditional solutions so far known, in deceleration the motor, which becomes a generator, throws away in resistance the energy that it produces, which is thus dispersed.

Figure 1:
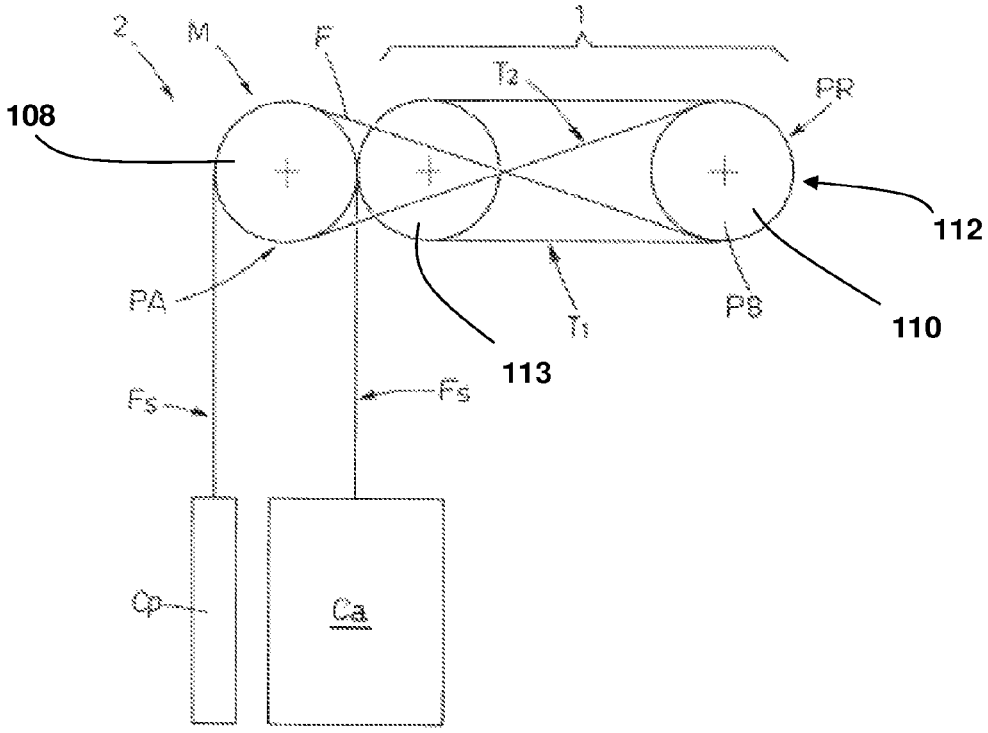
FIG. 1 is a schematic view of a handling plant of the lift type comprising a device according to the present invention.

FIG. 1 is a schematic view of handling plant 2 of the lift type provided with a device 1 according to the invention. The handling plant 2 is provided with an electric motor M and a plurality of handling cables Fs that are run over respective pulleys driven by the rotor (or motor shaft) of the motor M. A first end of the cables Fs supports a cab C having a weight Ca and a capacity Q. Anchored instead to the other end is a counterweight Cp, the weight of which is chosen so as to be Cp=Ca+½Q.

In the configuration shown schematically in FIG. 1, the device 1 according to the invention is installed according to a substantially "horizontal" arrangement, i.e., in such a way that the axes of rotation of the first rotating member PA and of the second rotating member PB are substantially parallel. Alternatively, the device 1 could also be installed according to a "vertical" arrangement, i.e., such that the axis of rotation of the motor M of the first member PA and of the second member PB are on one and the same vertical plane.

FIG. 2 is a top plan view regarding a first possible embodiment of a device 1 according to the present invention. According to this first solution, the first rotating member PA is connected to the motor M in such a way as to be fixed with respect thereto (same speed of rotation). The second rotating member PB is instead "idle" on a countershaft 9 which rotates about an axis X2 parallel to that of the rotor of the electric motor M. The second member PB is connected to the first member PA through the first transmission means T1, which comprise a gear transmission. In particular, the first member PA and the second member PB each comprise a gear PAr, PBr. Said gears PAr, PBr mesh each other, developing a transmission ratio equal to unity and defining said gear transmission. In particular, the gear PAr is fitted on the rotor R of the motor M and the gear PBr is mounted idle on said countershaft 9.

Once again with reference to FIG. 2, in this embodiment the second transmission means C comprise a bevel-gear transmission, which is configured in such a way that the third rotating member PR will turn in a direction of rotation opposite to that of the second rotating member PB. On the hypothesis, for example, that the latter turns in a clockwise direction, through the bevel-gear transmission the third member PB is driven in a counterclockwise rotation, and vice versa. It should be noted that, according to the solution in FIG. 2, the third rotating member PR rotates in a direction concordant with that of the first rotating member PA.

The bevel-gear transmission comprises a first bevel gear RC1, fixed with respect to the second rotating member PB, i.e., fixed with respect to the gear PBr. The transmission also comprises a second gear RC2 fixed with respect to the third rotating member PR, and a pair of planetary gears Sa, Sb (preferably, but not exclusively, two in number), which rotate around a fixed axis of rotation X, which is substantially orthogonal to the axis of rotation X2 of the countershaft 9. Said planetary gears Sa, Sb are responsible for reversal of the direction of rotation between the second member PB and the third member PR. The latter is idle on the same countershaft 9 on which also the gear PBr of the second rotating member PB is idle.

The third transmission means T2 provided for connecting the third member PR to the fourth member PM comprise a transmission with flexible elements and preferably with V belts CT. More precisely, the flexible-element transmission comprises two or more V belts CT run over the external body of the motor M, and a pulley P, which basically constitutes the third rotating member PR.

Said belts CT are held in the correct operative position by means of the grooves 4, 4B purposely made on the body of the pulley P and on the external body of the motor M. In this connection, it should be noted that the external body of the motor M comprises a number of grooves 4B equal to the sum of the number of handling cables FS of the system and of the V belts CT of the third transmission means T2. It should be noted that the V belts CT are run over the pulley P and the external body of the motor M in such a way that the third rotation member PR and the fourth rotation member PM tend to rotate in substantially concordant directions of rotation. The direction of rotation of the fourth rotating member PM will be in any case concordant with that of the first rotating member PA, i.e., of the rotor of the motor M on which the first member PA itself is fitted.

FIG. 3 regards a third possible embodiment of a device 1 according to the present invention. In particular, in this further embodiment the first rotating member PA comprises a first gear PAr fixed with respect to the rotor of the electric motor M. Likewise, the second rotating member PB comprises a gear PBr operatively connected to the gear PAr of the first member PA through first transmission means T1.

In a way similar to the solution illustrated in FIG. 2, the gear PBr of the second rotating member PB is mounted idle on a countershaft 9 supported by two longitudinal beams 25A, 25B which support, on opposite sides, also the electric motor M.

The first transmission means T1 comprise a gear transmission, including a return gear B which rotates about an axis Y parallel to the axis of rotation Y1 of the motor M (i.e., of the gear PAr) and parallel to the axis X2 of the countershaft 9, i.e., to the axis of rotation of the gear PBr of the second rotating member PB. In particular, the return gear B is mounted idle on a shaft 13, supported, via appropriate supports, by a longitudinal beam 25A. It should be noted that in this embodiment the gear transmission that defines the first of transmission T1 hence comprises the gears PAr, B and PBr, which develop a transmission ratio equal to unity according to the purposes of the present invention. In a way similar to what is envisaged for the solution of FIG. 2, also in the third embodiment illustrated in FIG. 3 the second transmission means C comprise a bevel-gear transmission configured in such a way that the third rotating member PR turns in a direction opposite to that of the second member PB. From a constructional point of view, the second transmission means C hence correspond to the ones already described for the solution in FIG. 2. In particular, the bevel-gear transmission comprises a first bevel gear RC1 fixed with respect to the second rotating member PB, i.e., fixed with respect to the gear PBr. The transmission likewise comprises a second gear RC2, fixed with respect to the third rotating member PR, and a pair of planetary gears Sa, Sb (preferably, but not exclusively two in number), which turn about a substantially fixed axis of rotation X orthogonal to the axis of rotation X2 of the countershaft 9. Said planetary gears Sa, Sb are responsible for reversal of the direction of rotation between the second member PB and the third member PR. The latter is idle on the same countershaft 9 as that on which the gear PBr of the second rotating member PB is also mounted idle.

It should be noted, instead, that unlike the embodiment of FIG. 2, in the embodiment of FIG. 3 the first rotating member PA (i.e., the gear PAr) and the second rotating member PB (i.e., the gear PBr) have the same direction of rotation, whereas the third rotating member PR has, instead, a direction of rotation concordant with that of the return gear B referred to above. In other words, the return gear B renders concordant the directions of rotation of the first rotating member PA and of the second rotating member PB, which has in any case a direction of rotation disconcordant with that of the third rotating member PR.

Once again with reference to the embodiment of FIG. 3, the third transmission means T2 are also formed by a gear transmission. Said solution hence proposes itself as an alternative to the one illustrated in FIG. 2, where the third transmission means T2 comprise a flexible-element transmission.

In greater detail, in the solution of FIG. 3, the third rotating member PR comprises a gear PRr sharing the axis of rotation X2 of the second rotating member PB, i.e., the axis of rotation of the bevel gears RC1 and RC2, which define the second transmission means C. Also the fourth rotating member PM comprises a gear PMr fitted on the shaft of the motor M on the opposite side with respect to the position of the gear PAr defining the first rotating member PA. The gear PMr of the fourth rotating member PM and the gear PRr of the third rotating member PR have a diameter that is substantially equivalent so as to present the same r.p.m., i.e., so as to develop a transmission ratio equal to unity. It should moreover be noted that the gear PMr of the fourth rotating member PM has a direction of rotation opposite to that of the gear PRr of the third rotating member PR and concordant, instead, with that of the gear PAr of the first rotating member PA. Basically, also in the solution in FIG. 3 the direction of rotation of the fourth rotating member PM is in any case concordant with that of the first rotating member PA, i.e., with that of the rotor to which both of the members (PA and PM) are fitted.

Figure 4:
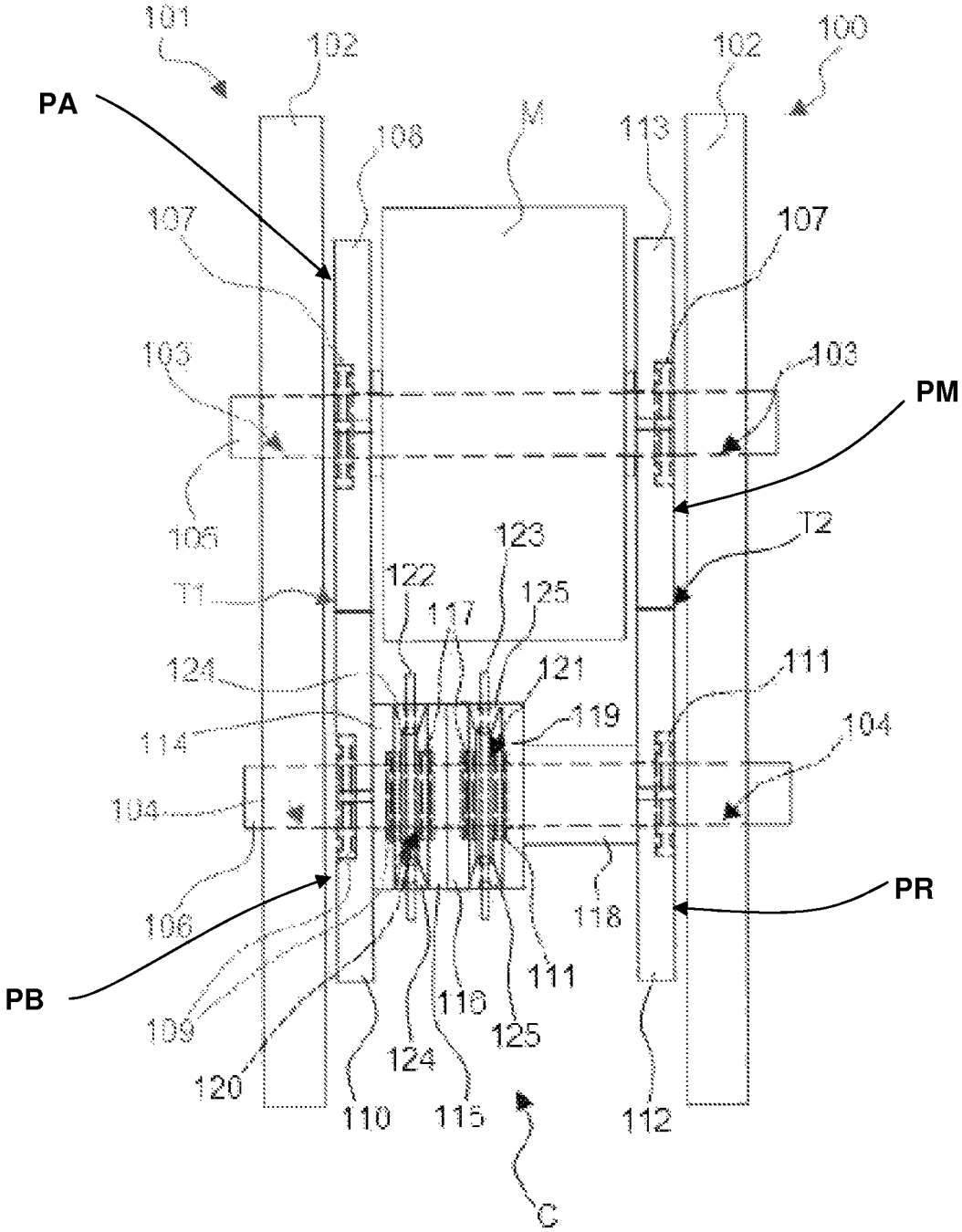
FIG. 4 is a top plan view of another further possible embodiment of a device according to the present invention.

Another embodiment of a device according to the present invention is illustrated in FIG. 4.

In this embodiment. the device, overall indicated with 100, comprises a support structure 101 consisting of two parallel plates 102.

The two parallel plates 102 are equipped with first circular housing 103 and with second circular housing 104 respectively for the installation of a first shaft 105 and a second shaft 106, parallel to each other.

The first shaft 105 and the second shaft 106 are installed fixed with respect to the plates 102, that is they can not rotate with respect to the latters.

On the first shaft 105 is installed in a rotating manner an electric motor M, on first bearings 107.

The motor M, by the rotor part thereof, is in turn coupled, for example through some not represented housing, to some rope of a handling plant, or other similar members.

A first rotating member 108 is coupled fixed with respect to the electric motor M, in particular to the external rotor part thereof. The first rotating member 108 is made up of a first gear, for example with helical teeth, fitted in a rotating manner on the first shaft 105.

On the second shaft 106 is fitted in a rotating manner, on second bearings 109, a second rotating member 110 connected to the first rotating member 108. The second rotating member 110 is made up of a second gear, for example with helical teeth, that meshes the first gear 108, thus realizing first transmission means T1.

The transmission ratio between the first rotating member 108 and the second rotating member 110 is substantially equal to unity. In other words, the first gear 108 and the second gear 110 have the same number of teeth.

On the second shaft 106 is also is fitted in a rotating manner, on third bearings 111, a third rotating member 112—made up with a third gear, for example with helical teeth—which is connected to the second rotating member 110 as better described below.

The number of the teeth of the third gear 112 is the same as those of the second gear 110.

A fourth rotating member 113 is coupled fixed with respect to the motor M, particularly to the external rotor thereof, on the opposite side compared to the first rotating body 108, which then rotates so concordant with the fourth rotating member 113.

The fourth rotating member 113 is made up with a fourth gear, for example with helical teeth, fitted in a rotating manner on the first shaft 105, still through the first bearings 107.

The fourth gear 113 meshes the third gear 112, thus realizing third transmission means T2, already described in earlier forms of embodiment.

The transmission ratio between the fourth rotating member 113 and the second rotating member 110 is substantially equal to unity. In other word, the fourth gear 113 and the second gear 112 have the same number of teeth.

To the second rotating member 110, that is the second gear, is coaxially fixed a first bevel gear 114, which therefore is also fitted in a rotating manner on the second shaft 106 on second bearings 109.

A second bevel gear 115 and a third bevel gear 116 are even fitted in a rotating manner on the second shaft 106, particularly on fourth bearings 117.

The second bevel gear 115 and the third bevel gear 116 are fixed with respect to each other.

The third rotating member 112, that is the third gear, is coaxially fixed with respect to a sleeve 118, fitted in a rotating manner on the second shaft 106.

A fourth bevel gear 119 is fixed with respect to the sleeve 118, and therefore it is fitted in a rotating manner on the second shaft 106 through the aforementioned third bearings 111.

As seen in FIG. 4, on the second shaft 106 are provided a first hole 120 and a second hole 121, with parallel and diametrical axis respect to the same second shaft 106.

In the first hole 106 is locked a first planet carrier 122, while in the second hole 121 is fixed a second planet carrier 123, both shape rod.

At the ends of the first planet carrier 122 are fitted in a rotating manner first bevel planetary gears 124, at the ends of the second planet carrier, are fitted in a rotating manner second bevel planetary gears 125.

The bevel gears 114, 115, 116, 119, for example the helical bevel type, show all the same number of teeth.

The first bevel gear 114 and the second bevel gear 115 are mounted in opposition, and both mesh with the first planetary gears 124.

In the same way, the third bevel gear 116 and the fourth bevel gear 119 are mounted in opposition and both mesh with the fourth planetary gears 125.

By this way second means of transmission C are obtained, which connect the second rotating member 110 with the third rotating member 112.

Therefore, during the drive transmission from the first bevel gear 114 to the second bevel gear 115 there is a first reversal of the drive direction, with a unitary transmission ratio, while during the drive transmission from the third bevel gear 116—fixed with respect to the second bevel gear 115—and the fourth bevel gear 119 there is a second reversal of the drive direction, with an unitary transmission ratio too.

All the bearings 107, 109, 111, 117, are the tapered roller bearings kind. to support the loads generated by the helical teeth gears.

Even the embodiment according to the FIG. 4 achieves the effects and the advantages already described for the previous embodiments, with regards to the reduction of the required torque for the handling.

The motion, due to the motor M, may develop, with the same efficiency, starting from the first rotating member 108 until reaching the fourth rotating member 113, or starting from the fourth rotating member 113 until reaching the first rotating member 108, according to the position reached by the handling plant.

The traction, due to the motor M, may develop, at random starting from the first rotating member 108 or from the fourth rotating member 113. In the event that the first rotating body 108 is the engine, the fourth rotating body 113 will be the engine braking, vice versa, in the event that the fourth rotating body 113 is the engine, the first rotating body 108 will be the engine braking.

Furthermore, the present embodiment is built up in a more secure manner than the embodiments described above.

In fact, the absence of transmissions made with belt or ropes allows to get a more solid and reliable construction, moreover the maintenance, the parts replacements, and so on, are also limited.

Still, is possible to get more precise gear ratios between the various components than the versions with belt drives.

The use of cylindrical gears and spiral bevel gears also ensures silent pairs. Another embodiment of the device, according to the present invention, is illustrated in FIG. 5.

This embodiment comprises, in addition to the elements described above, further elements as describes as follow.

Figure 5:
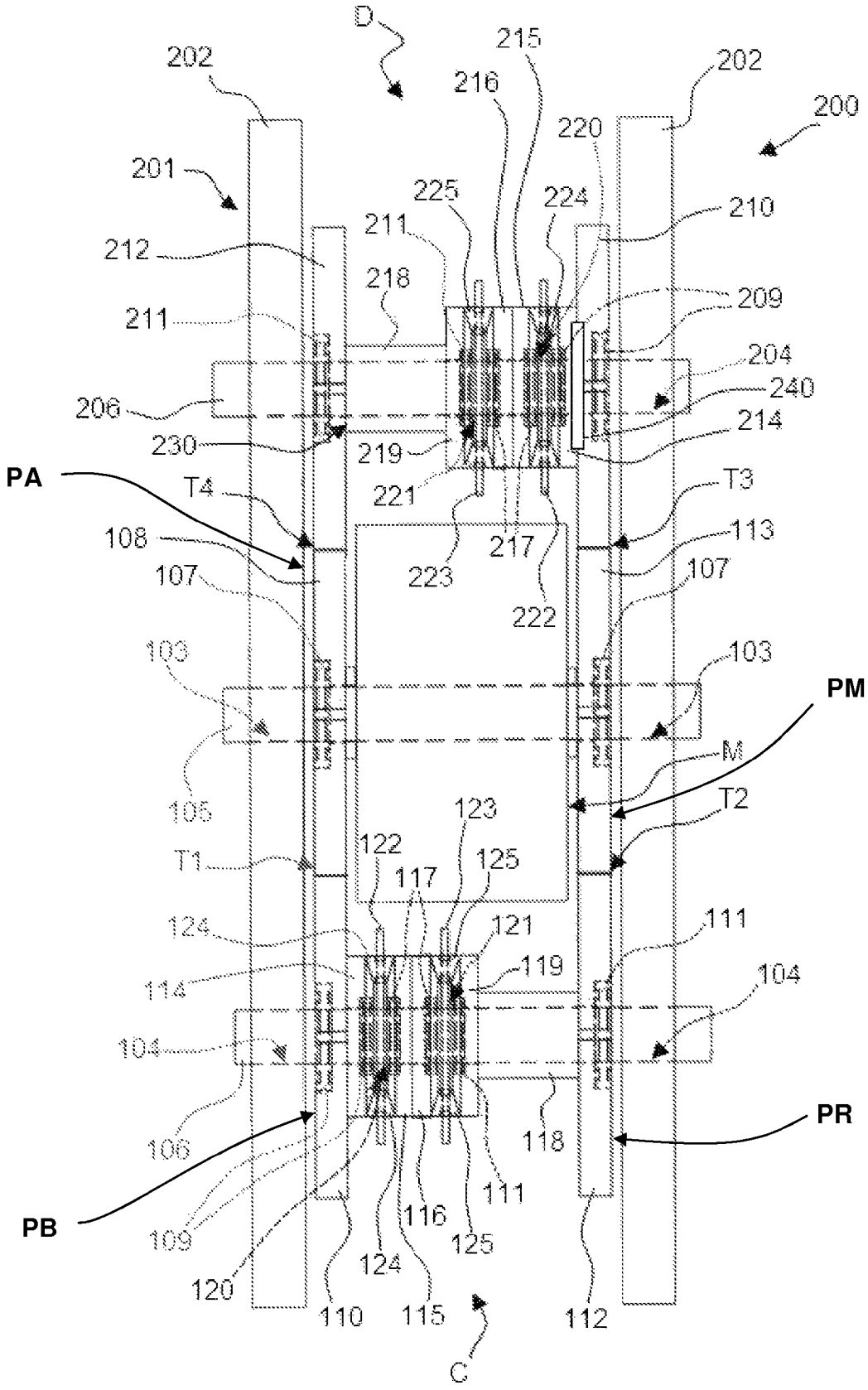
FIG. 5 is a top plan view of a further embodiment of the device according to the present invention.

With reference to FIG. 5, the device, overall indicated with 200, comprises a support frame 201 consisting of two parallel plates 202.

The two parallel plates 202 are equipped with first circular housings 103 for the installation of a first shaft 105, of second circular housings 104 for the installation of a second shaft 106 in a parallel manner respectively to the first shaft 105 and of third circular housings 204 for the installation of a third shaft 206, parallel to the first shaft 105 and to the second shaft 106.

The third shaft 206 is installed fixed with respect to the plates 202, that is it can not rotate with respect to the latters.

On the third shaft 206 is fitted in a rotating manner, on fifth bearings 209, a fifth rotating member 210, connected to the fourth rotating member 113. The fifth rotating member 210 is made up of a fifth gear, for example with helical teeth, that meshes the fourth gear 113, thus realizing fourth transmission means T3.

The transmission ratio between the fourth rotating member 113 and the fifth rotating member 210 is substantially equal to unity. In other words, the fourth gear 113 and the fifth gear 210 have the same number of teeth.

On the third shaft 206 is also fitted in a rotating manner, on sixth bearings 211, a sixth rotating member 212—made up with a sixth gear, for example with helical teeth—which is connected to the fifth rotating member 210 as better described below.

The sixth rotating member 212 meshes the first gear 108, thus realizing sixth transmission means T4.

The number of the teeth of the sixth gear 212 is the same as those of the fifth gear 210.

A fifth bevel gear 214 is coaxially fixed to the fifth rotating member 210, i.e. the fifth gear, by an elastic joint 240, thus the fifth bevel gear 214 is also fitted in a rotating manner on the third shaft 206 on third bearings 209.

The elastic joint 240, moreover, ensures a constant contact between the teeth of the fifth rotating member 210 meshing with the teeth of the fourth rotating member 113.

A sixth bevel gear 215 and a seventh bevel gear 216 are even fitted in a rotating manner on the third shaft 206, particularly on seventh bearings 217.

The sixth bevel gear 215 and the seventh bevel gear 216 are fixed with respect to each other.

The sixth rotating member 212, that is the sixth gear, is coaxially fixed, by first fastening means 230, with respect to a second sleeve 218, fitted in a rotating manner on the third shaft 206.

Figure 6:
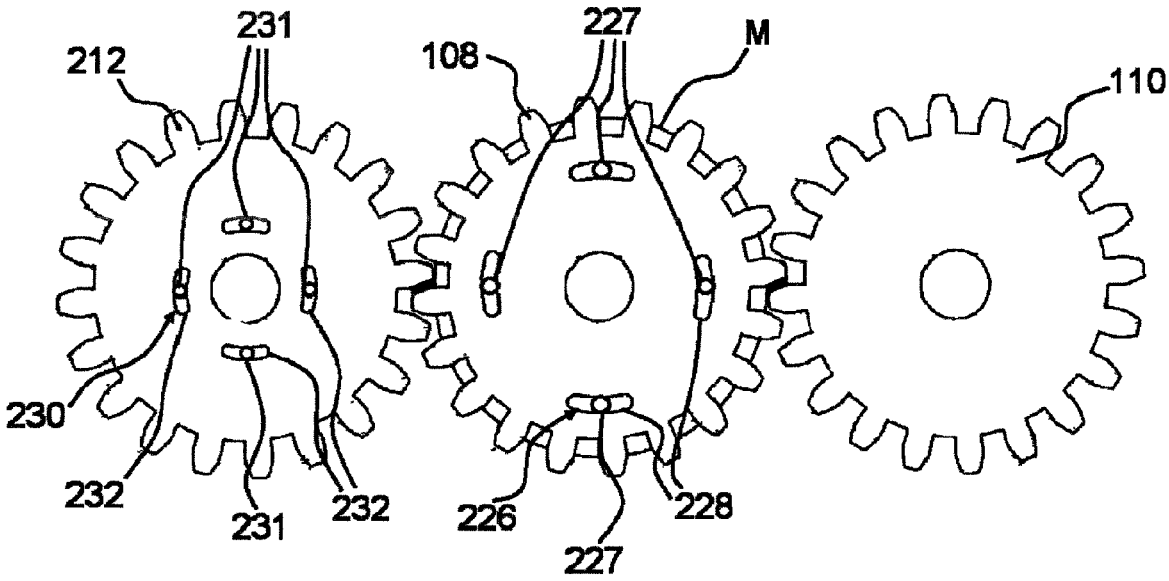
FIG. 6 is a side view of the embodiment of FIG. 5.
Figure 7:
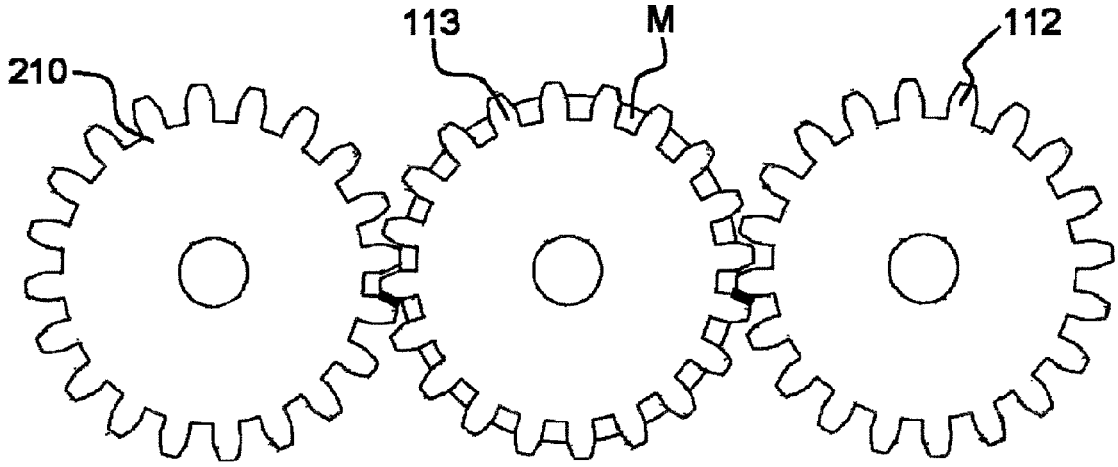
FIG. 7 is a side view of the embodiment of FIG. 5.

As shown in FIG. 6, the first fastening means 230 comprise first connecting elements 231 housed within first seats 232 formed in the sixth rotating member 212.

The first connecting elements 231 can be, for example, bolts and/or hexagonal head screws and/or similar fastening elements of known type.

The first seats 232 comprise at least two slots arranged along a circle with a radius less than the pitch radius of the sixth rotating member 212.

The first fastening means 230 allow to adjust the relative position between the sixth rotating member 212 and the second sleeve 218 if such adjusting would need to do, for example during the installation of the device 200 itself.

Further, by the first fastening means 230 the recovery of any clearance between the sixth rotating member 212 and the first rotating member 108 is possible, and the optimum contact between the teeth of such gears is granted.

A eighth bevel gear 219 is fixed with respect to the second sleeve 218, and therefore it is also fitted in a rotating manner on the third shaft 206 through the aforementioned sixth bearings 211.

The eighth bevel gear 219 and the sixth rotating member 212 are fixed with respect to each other.

As shown in FIG. 5, on the third shaft 206 are provided a third hole 220 and a fourth hole 221, with parallel and diametrical axis respect to the same third shaft 206.

In the third hole 220 is locked a third planet carrier 222, while in the fourth hole 221 is fixed a fourth planet carrier 223, both shape rod.

At the ends of the third planet carrier 222 are fitted in a rotating manner third bevel planetary gears 224, at the ends of the fourth planet carrier, are fitted in a rotating manner fourth bevel planetary gears 225.

The bevel gears 214, 215, 216, and 219, for example the helical bevel type, show all the same number of teeth.

The fifth bevel gear 214 and the sixth bevel gear 215 are mounted in opposition, and both mesh with the third planetary gears 224.

In the same way, the seventh bevel gear 216 and the eighth bevel gear 219 are mounted in opposition and both mesh with the fourth planetary gears 225.

By this way fifth means of transmission D are obtained, which connect the fifth rotating member 210 with the sixth rotating member 212.

Therefore, in a similar manner as described before, during the drive transmission from the fifth bevel gear 214 to the sixth bevel gear 215 there is a first reversal of the drive direction, with a unitary transmission ratio, while during the drive transmission from the seventh bevel gear 216 and the eighth bevel gear 219 there is a second reversal of the drive direction, with an unitary transmission ratio too.

Even in this embodiment, the bearings 209, 211, and 217, are the tapered roller bearings kind. to support the loads generated by the helical teeth gears.

Even the embodiment according to the FIG. 5 achieves the effects and the advantages already described for the previous embodiments, with regards to the reduction of the required torque for the handling, furthermore increasing the balance and the distribution of the stress transmitted to the various rotating members.

Further, introducing the fifth and the sixth rotating member 210, 212, at constant torque transmitted, the stress to which the teeth of each gear are subjected, is reduced.

With reference to FIG. 6, the first rotating member 108 is connected to the motor M by second fastening means 226.

The second fastening means 226 comprise second connecting elements 227 housed within second seats 228 formed in the first rotating member 108.

The second connecting elements 227 can be, for example, bolts and/or hexagonal head screws and/or similar fastening elements of known type.

The second seats 228 comprise at least two slots arranged along a circle with a radius less than the pitch radius of the first rotating member 108.

Through the above mentioned connection, the first rotating member 108 can be partially rotated, in a relative manner, with respect to the motor M. When a desired positioning is reached the second fastening means 226 can be completely tightened, thus obtaining a connection between the first rotating member 108 and the motor M.

Doing so, an optimum positioning between the teeth of the first rotating member 108 respectively with the teeth of the second rotating member 110 and the sixth rotating member 212, and the granting an optimum contact between the teeth of such gears, can be achieved.

Furthermore, the possibility of adjusting the position of the gears in contact with the first rotating member 108 allows to simplify the installation of the device 200, and to recover the clearances that can be between the gears.

The stress generated by the resistant torque or by the leading torque on the gear teeth is indicated by the term motive.

Consequently, as already mentioned, the traction, due to the motor M, may develop, at random starting from the first rotating member 108 or from the fourth rotating member 113. In the event that the first rotating body 108 is the engine, the fourth rotating body 113 will be the engine braking, vice versa, in the event that the fourth rotating body 113 is the engine, the first rotating body 108 will be the engine braking.

Furthermore, the present embodiment is built up in a more secure manner than the embodiments described above.

Indeed, the presence of further fifth and sixth rotating member 210, 212, results in precise transmission ratios between the various components and a better distribution of the stress between the various gear in the device 200. The stress to which each tooth is subject, equal to the stress due to the motor M traction, are less than the one of the previous embodiments.

Moreover, the presence of the elastic joint 240, for example realized by linking some springs to the fifth rotating member 210, ensures a constant mesh between the teeth of the fifth rotating member 210 and the teeth of the fourth rotating member 113, during the rotation thereof.

The use of fourth transmission means T3, of fifth transmission means D, and of sixth transmission means T4 allows to significantly increase the energy savings that is possible to reach by the device 200.

Through the use of the present embodiment is possible to reach a power saving between 80% and 90%, almost twice the energy savings obtained by the embodiments previously described, and particularly to the embodiment in which there are only first, second, and third transmission means respectively T1, C, and T2.

The present invention also regards a handling plant 2 comprising an electric motor M that actuates at least one transport unit through a system of cables and/or belts. The handling plant 2 according to the invention comprises a mechanical device 1 according to the invention for reducing the energy absorbed by the electric motor of the system itself. The handling plant 2 can be of the lift type or alternatively could also be constituted by a cup elevator or any other plant for moving material that uses flexible transmission elements for actuation of the unit or units for transporting the loads.

Furthermore, it is to be noted that the mechanical device 1 can be used also in motors acting as generators (for example alternators). In that case, the resistant torque of the motor acting as generator is reduced (preferably annulled) by the device 1 according to the present invention. Nevertheless, it remains to overcome the frictions due to the mechanism itself (friction, efficiency of the transmission means, T1, C and T2).

The technical solutions adopted for the mechanical device enable the pre-set task and purposes to be fully achieved. In particular, the mechanical device advantageously enables reduction of the power absorbed by the electric motor during operation of the handling plant to which the motor is associated. In addition, the completely mechanical device enables said reduction of energy without intervening on the structure of the electric motor. It should be noted also that the mechanism is obtained using a relatively small number of components that can be assembled at contained costs. It is then emphasized that the mechanisms described above can create an energy saving not only in handling plants, and within certain limits, but also in horizontal movement, where the resistant torque can be split into two torques that counter one another and cancel out.

The mechanical device thus conceived may undergo numerous modifications and variations, all of which fall within the scope of the inventive idea; in addition, all the items may be replaced by other technically equivalent ones.

In practice, the materials used, as well as the contingent dimensions and shapes, may be any whatsoever according to the requirements and the state of the art.

The invention claimed is:

1. A mechanical device (200) for reducing the energy absorbed by an electric motor (M) of a material and/or person handling system (2), wherein said device (200) comprises:

a first rotating member (108), connected to an external rotor of said motor (M);

a second rotating member (110), connected to the first rotating member (108) through first transmission means (T1) that develops a transmission ratio substantially equal to unity;

a third rotating member (112), connected to said second rotating member (110) through second transmission means (C) that develops a transmission ratio substantially equal to unity;

a fourth rotating member (113), connected to the external rotor of said motor (M) on an opposite side of said motor (M) with respect to said first rotating member (108) and connected to said third rotating member (112) through third transmission means (T2) that develops a transmission ratio substantially equal to unity, in which said fourth rotating member (113) rotates in a same direction as said first rotating member (108);

a fifth rotating member (210), connected to said fourth rotating member (113) through fourth transmissions means (T3) that develops a transmission ratio substantially equal to unity;

a sixth rotating member (212) connected to said fifth rotating member (210) through fifth transmissions means (D) that develops a transmission ratio substantially equal to unity;

said sixth rotating member (212) connected to said first rotating member (108) through sixth transmission means (T4) that develops a transmission ratio substantially equal to unity;

said second transmission means (C) comprising a series of bevel gears (114, 115, 116, 119) comprising:

a first bevel gear (114) and a second bevel gear (115) mounted in opposition and both meshed with first planetary gears (124);

a third bevel gear (116) and a fourth bevel gear (119) mounted in opposition and both meshed with fourth planetary gears (125); the second bevel gear (115) and the third bevel gear (116) being fixed with respect to each other;

said fifth transmission means (D) comprising a series of bevel gears (214, 215, 216, 219) comprising:

a fifth bevel gear (214) and a sixth bevel gear (215) mounted in opposition and both meshed with third planetary gears (224);

a seventh bevel gear (216) and a eighth bevel gear (219) mounted in opposition and both meshed with fourth planetary gears (225); the sixth bevel gear (215) and the seventh bevel gear (216) being fixed with respect to each other.

2. The mechanical device according to claim 1, wherein said fifth transmission means (D) comprises a fifth bevel gear (214) connected with said fifth rotating member (210), a sixth bevel gear (215) coupled with said fifth bevel gear (214) by the third planetary gear (224), a seventh bevel gear (216) connected with said sixth bevel gear (215) and an eighth bevel gear (219) coupled with said seventh bevel gear (216) by the fourth planetary gear (225) and connected with said sixth rotating member (212).

3. The mechanical device according to claim 2, wherein said fifth rotating member (210), said fifth bevel gear (214), said sixth bevel gear (215), said seventh bevel gear (216), said eighth bevel gear (219) and said sixth rotating member (212) are fitted in a rotating manner on a third shaft (206).

4. The mechanical device according to claim 3, wherein said third planetary gear (224) is installed at the ends of a third planet carrier (222) mounted in a third hole (220) realized in said third shaft (206).

5. The mechanical device according to claim 4, wherein said fourth planetary gear (225) is mounted at the ends of a fourth planet carrier (223) mounted in a fourth hole (221) realized in said third shaft (206).

6. The mechanical device according to claim 2, wherein said fifth bevel gear (214), said sixth bevel gear (215), said seventh bevel gear (216) and said eighth bevel gear (219) are helical.

7. The mechanical device according to claim 3, wherein said eighth bevel gear (219) and said sixth rotating member (212) are connected by a second sleeve (218) fitted with said third shaft (206).

8. The mechanical device according to claim 7, wherein said sixth rotating member (212) is connected to said second sleeve (218) through first fastening means (230) comprising first connection elements (231), housed inside first seats (232) in said sixth rotating member (212).

9. The mechanical device according to claim 8, wherein said first seats (232) comprise at least two slots arranged along a circle with a radius less than a pitch radius of said sixth rotating member (212).

10. The mechanical device according to claim 8, wherein said first connection elements (231) comprise bolts and/or hexagonal head screws.

11. The mechanical device according to claim 3, wherein said fifth rotating member (210) is coaxially fitted to said fifth bevel gear (214) through an elastic joint (240).

12. The mechanical device according to claim 3, comprising a support frame (201) comprising parallel plates (202) provided with a first circular housing (103) for a fixed mounting of a first shaft (105) of a second circular housing (104) for a fixed mounting of a second shaft (106) in a parallel manner with respect to said first shaft (105) and a third circular housing (204) for a fixed mounting of said third shaft (206) in a parallel manner with respect to said first shaft (105) and said second shaft (106).

13. The mechanical device according to claim 1, wherein said first rotating member (108) is connected to said motor (M) through second fastening means (226) comprising second connection elements (227) housed inside second seats (228) in said first rotating member (108).

14. The mechanical device according to claim 13, wherein said second seats (228) comprise at least two slots arranged along a circle with a radius less than a pitch radius of said first rotating member (108).

15. The mechanical device according to claim 1, wherein said fifth rotating member (210) and said sixth rotating member (212) are cylindrical helical gears and have a same number of teeth.

16. A material and/or person handling system (2) comprising at least the mechanical device (200) according to claim 1.

* * * * *